United States Patent [19]

Murakami et al.

[11] Patent Number: 4,784,740

[45] Date of Patent: Nov. 15, 1988

[54] PLATING CELL WITH EDGE MASKS

[75] Inventors: Shinjiro Murakami; Seiichi Takahashi; Masahiko Urakami, all of Okayama, Japan

[73] Assignee: Kawasaki Steel Corporation, Kobe, Japan

[21] Appl. No.: 101,934

[22] Filed: Sep. 24, 1987

[30] Foreign Application Priority Data

Sep. 26, 1986 [JP] Japan ..... 61-227337

[51] Int. Cl.[4] ..... C25D 17/00

[52] U.S. Cl. ..... 204/206

[58] Field of Search ..... 204/206

[56] References Cited

U.S. PATENT DOCUMENTS 4,427,520 1/1984 Bahnsen et al. ..... 204/224 R

FOREIGN PATENT DOCUMENTS 378009 6/1985 Austria .
3151515 7/1983 Fed. Rep. of Germany .
53-54505 12/1978 Japan .
58-113396 7/1983 Japan .
58-113396 7/1983 Japan .
58-168567 11/1983 Japan .
59-21667 2/1984 Japan .
60-117863 8/1985 Japan .
1369323 10/1974 United Kingdom .

*Primary Examiner*—T. M. Tufariello
*Attorney, Agent, or Firm*—Young & Thompson

[57] ABSTRACT

In a radial plating cell comprising a winding roll for winding thereon a metal strip, an arch-shaped anode spaced at a predetermined distance from the winding roll, and a pair of edge masks interposed between the winding roll and the anode in register with the edges of the metal strip, a mechanism for moving the edge mask is comprised of a drive screw and a travelling nut engaged thereon and received in a channel which is formed in the anode surface and extends in the transverse direction of the metal strip, whereby the edge mask secured to the nut is moved along the drive screw with rotation of the drive screw.

8 Claims, 8 Drawing Sheets

PLATING CELL WITH EDGE MASKS

BACKGROUND OF THE INVENTION

This invention generally relates to an apparatus for electrolytically processing metal workpieces, including zinc and tin electroplating installations. More particularly, it relates to a radial plating cell comprising a winding roll for winding a metal strip thereon and an arch-shaped anode wherein electrolytic solution passes between the winding roll and the anode.

Surface-treated steel strips are often produced by subjecting steel strips to electrolytic plating. In such electrolytic plating, abnormal deposits are sometimes formed on edge portions of a metal strip or a workpiece to be plated. Such abnormal plating phenomena will be readily understood by referring to FIG. 9. There are known two phenomena both due to local concentration of electric current as shown by arrows 56 at an edge 51' of a metal strip substrate 51. One phenomenon is known as edge overcoating wherein a deposit 54 on the metal strip edge 51' becomes thicker than a deposit 52 on an intermediate portion of the metal strip. The other phenomenon is known as edge whisker wherein plating metal deposits and grows on the metal strip edge 51' to form whiskers 55. When these phenomena take place, undesirably the metal deposit on the metal strip edge 51' tends to spall from the metal strip substrate 51. Metal spalls that have separated from the substrate will deposit on rolls or molds in the plating line or a subsequent pressing line, causing scratches or damages to the product.

Formation of such an edge overcoat 54 and edge whiskers 55 may be controlled by interposing insulating plates 18 between the anodes 16 and the metal strip substrate 51 in proximity to its edge as shown in FIG. 10, thereby preventing current from concentrating at the strip edge. These insulating plates 18 are known as edge masks. The use of edge masks is known for horizontal and vertical plating cells from Japanese Utility Model Application Kokai Nos. 58-168567, 59-21667, and 60-117863, and Japanese Patented Publication No. 53-54505.

FIGS. 11 and 12 illustrate a conventional horizontal plating cell 60 having a variety of drive means for driving a support 19 of an edge mask. In general, U-shaped edge masks 18 are inserted between the anodes 16 in proximity to the edges of a metal strip 12 by moving the support 19 back and forth through the drive means. The drive means used may be in the form of, for example, a hydraulic cylinder 62, an electrically powered cylinder 64, a rack and pinion 66, or a screw jack 68. This edge mask inserting method can be effectively applied to both horizontal and vertical plating cells.

FIGS. 13 and 14 illustrate a conventional radial plating cell 10 having a variety of drive means for driving a support 19 of an edge mask. Generally, the radial plating cell 10 includes a winding roll 14 for winding a metal strip thereon and an arch-shaped anode 16 opposed to the winding roll. The distance d between the winding roll 14 and the anode 16 must be increased in order to allow edge masks 18 to be inserted between the metal strip 12 and the anode 16, losing the advantage of the radial plating cell that a narrow gap can be kept between the metal strip 12 and the anode 16.

With the conventional arrangements illustrated, the edge masks 18 will swing or vibrate between the metal strip 12 and the anode 16. If the edge masks 18 contact the metal strip 12, both the metal strip 12 and the edge masks 18 are mechanically damaged. The supports 19 for holding the edge masks 18 must then be of high stiffness. It is difficult to increase the stiffness of the edge mask support 19 which is to be inserted in the narrow spacing between the metal strip 12 and the anode 16. The use of a thick support 19 with high stiffness will undesirably close partially the path for electrolytic solution flowing between the winding roll 14 and the anode 16. It is then difficult to maintain uniform distribution of flow velocity of plating solution between the metal strip 12 and the anode 16 in a transverse direction or a direction perpendicular to the moving direction of the metal strip.

Since drive means for moving each edge mask 18, for example, a hydraulic cylinder 62, an electrically powered cylinder 64, a rack and pinion 66, or a screw jack 68 is located outside the cell, another problem contemplated in these arrangements is a large extra space occupied by the drive means.

A prior arrangement wherein edge masks are inserted between the winding roll and the anode was proposed in Japanese Patent Application Kokai No. 58-113396.

In the plating cell according to this disclosure, edge masks are inserted between the winding roll and the anode, namely, in the spacing between two electrodes. The support for holding the edge masks are located nearer to the winding roll and fixed by guide rod and further by guide roller.

This arrangement serves to prevent the edge overcoat, but fails in narrowing the spacing between the electrodes to the desired extent, and still has unsatisfactory defects such as complicated structure of edge masks, difficulty in controlling for the movement of edge masks and tendency to causing troubles in operation.

There is thus the need for edge masks having simple structure, less problems for controlling the movement thereof and enabling safe operation for a long time.

SUMMARY OF THE INVENTION

A primary object of the present invention is to provide an improved radial plating cell wherein to allow electrolytic solution to smoothly flow through the path between a metal strip on a winding roll and an arch-shaped anode, means for moving a pair of edge masks to be located in register with the transverse width of the metal strip is received in a channel formed in the surface of the anode that is opposed to the winding roll.

Another object of the present invention is to provide such a radial plating cell wherein the channel is provided with a cover to ensure a uniform distribution of flow velocity of plating solution in the path.

A further object of the present invention is to provide such a radial plating cell wherein means for controlling the movement of the edge masks is provided to locate the edge masks in register with the transverse width of the metal strip.

The present invention is directed to a radial plating cell comprising a winding roll for winding thereon a metal strip having longitudinal and transverse directions, an arch-shaped anode opposed to the winding roll and spaced at a predetermined distance from the winding roll, a pair of edge masks interposed between the winding roll and the anode so as to be in register with the edges of the metal strip, means for moving each of the edge masks in the transverse direction of the metal strip, and drive means for driving the moving means.

According to the feature of the present invention, the moving means comprises a drive screw and a travelling nut threadably engaged on the drive screw, the edge mask is operatively connected to the travelling nut, and the moving means is located in a channel which is formed in the surface of the anode that is opposed to the winding roll and extends in the transverse direction of the metal strip. With rotation of the drive screw, the travelling nut and hence, the edge mask is thus moved axially of the drive screw.

Preferably, the edge mask is fixedly secured to the travelling nut.

In a further preferred embodiment, a cover is located over the channel, the cover preferably extending the axial distance of the channel.

In an embodiment where a plurality of moving means are provided for each edge mask, they are synchronously driven by the drive means. Any desired synchronous drive mechanism may be utilized including a pulley and belt mechanism and a ball joint and gear mechanism.

In a further preferred embodiment, means for controlling the distance of movement of the edge mask is provided. The control means may comprise a detector for counting the number of revolutions of the drive screw.

Preferably arch-shaped anode is insoluble.

BRIEF DESCRIPTION OF THE DRAWINGS

The above and other objects, features, and advantages of the present invention will be better understood by reading the following description taken in conjunction with the accompanying drawings, in which.

DETAILED DESCRIPTION OF THE INVENTION

Figure 1:
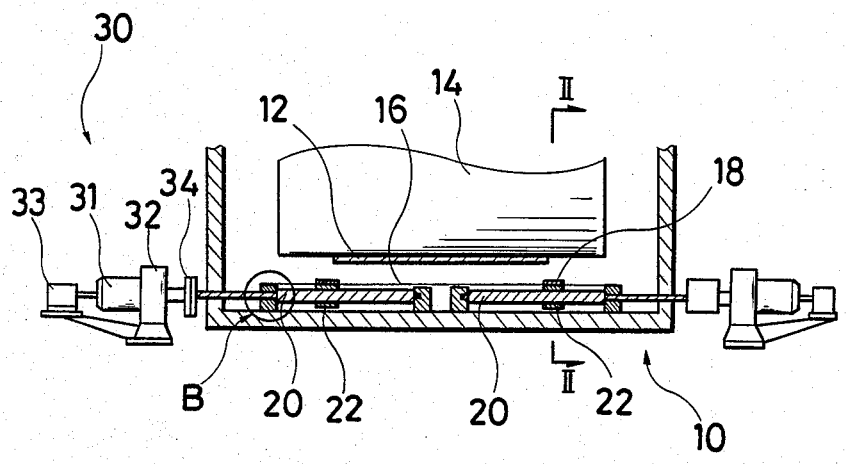
FIG. 1 is a partially cross-sectional elevation of a radial plating cell according to one embodiment of the present invention.
Figure 2:
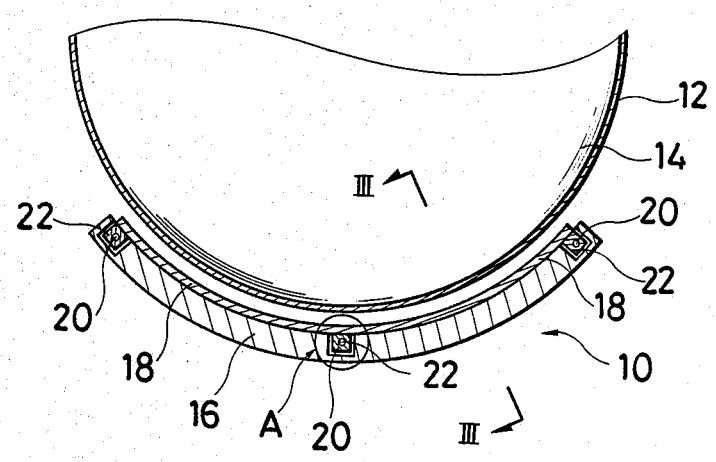
FIG. 2 is a cross-sectional view taken along lines II—II in FIG. 1.

Referring to FIGS. 1 and 2, there is illustrated a radial plating cell 10 according to one embodiment of the present invention. The cell 10 is shown as comprising a winding roll 14 for winding thereon a metal strip 12 having a longitudinal and transverse dimensions, carrying the strip, and serving as a cathode, an arch-shaped anode 16 opposed to the winding roll 14 and spaced at a predetermined distance therefrom, a pair of edge masks 18, and means for moving the edge masks 18. The longitudinal and transverse directions of the metal strip correspond to the circumferential and axial directions of the roll, respectively. Each moving means includes a drive screw 20 and a travelling nut 22 engaged thereon so as to travel along the screw 20. The cell further comprises, for each edge mask, a cover 24, a bearing 26 for the drive screw, a channel 28 for receiving and guiding the travelling nut 22 when it moves along the drive screw 20, and a drive mechanism 30. The drive mechanism 30 includes a motor 31, a gear box 32, a revolution detector 33, and a pulley 34. In the illustrated embodiment, three drive screws 20 are provided for each edge mask at its center and opposite ends.

Figure 3:
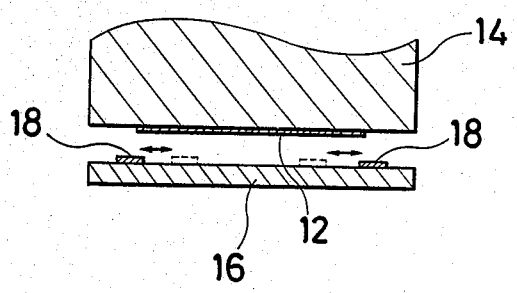
FIG. 3 is a cross-sectional view taken along lines III—III in FIG. 2.

As shown in FIG. 2, each edge mask 18 is an insulating plate having an arch-shaped cross section in conformity with the arch-shaped anode 16. The edge mask 18 is interposed in the plating solution path which is defined between the winding roll 14 and the arch-shaped anode 16, and moved therein in the transverse direction of the metal strip 12 so as to be in register with the corresponding edge of the metal strip. Since the spacing between the winding roll 14 and the anode 16 is narrow, the edge masks 18 are inserted in the path in contact with the surface of the anode 16 such that the edge masks 18 may move along the anode surface as shown in FIG. 3.

A mechanism for moving the edge mask 18 may be constituted by the drive screw 20, the travelling nut 22, and the channel 28. More particularly, the channel 28 is formed in the surface of the anode 16 that is opposed to the winding roll 14 and extends in a direction perpendicular to the direction of movement of the metal strip 12, that is, in the transverse direction of the metal strip 12. The drive screw 20 having the travelling nut 22 threadably engaged thereon extends in the channel 28 such that the nut 22 may fit in the channel 28. In the illustrated embodiment, both the channel and the nut have rectangular cross sections although it is satisfactory if they have conforming shapes which enable linear motion of the nut with rotation of the drive screw. When the drive screw 20 is rotated, the travelling nut 22 is moved along the drive screw 20. Since the edge mask 18 is fixedly secured on the travelling nut 22, the mask 18 is moved with the nut 22.

Since the drive screw 20 and the travelling nut 22 are accommodated in the channel 28 in the anode 16, a shaft or any member which will otherwise disturb the flow of plating solution is absent between the winding roll 14 and the anode 16. Elimination of a disturbing member enables to keep a uniform distribution of flow velocity of plating solution between the metal strip 12 and the anode 16 in a transverse direction of the metal strip.

Even in this arrangement, there is the possibility that the channel 28 having the drive screw 20 and the travelling nut 22 accommodated therein create a flow resistance against the flow of plating solution passing between the winding roll 14 and the anode 16, preventing the plating solution from smoothly passing between the winding roll 14 and the anode 16. If the solution does not flow smoothly, oxygen which is generated through electrolysis would stagnate between the anode 16 and the metal strip 12, inducing quality defects like burnt deposits in the resulting product.

Figure 4A:
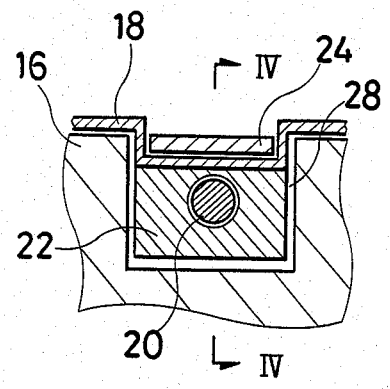
FIG. 4*a* is an enlarged cross-sectional view of a portion surrounded by circle A in FIG. 2.
Figure 4B:
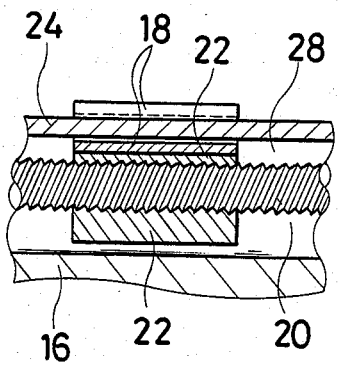
FIG. 4*b* is a cross-sectional view taken along lines IV—IV in FIG. 4*a;*
Figure 5A:
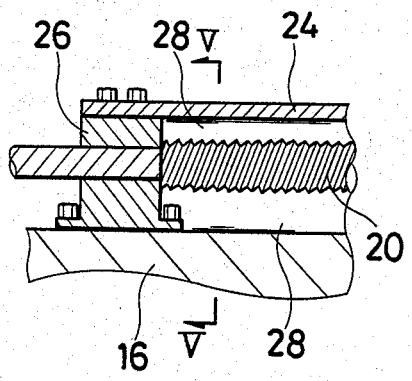
FIG. 5*a* is an enlarged cross-sectional view of a portion surrounded by circle B in FIG. 1.
Figure 5B:
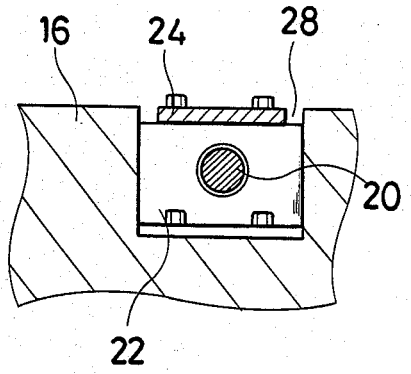
FIG. 5*b* is a cross-sectional view taken along lines V—V in FIG. 5*a;*

To avoid such inconvenience, as shown in FIGS. 4*a* and 4*b*, the channel 28 is provided with the cover 24 in the practice of the present invention. In this embodiment, the edge mask 18 is folded to form a recessed or concave portion which fits in the channel 28 and is secured to the travelling nut 22. The cover 24 is fitted in the recessed portion of the mask 18 such that the upper surface of the cover 24 is flush with the surface of the anode 16 that is opposed to the winding roll 14. The cover 24 extends the entire length of the channel and is secured to the bearing 26 of the drive screw 20 so as to entirely cover the channel 28 as shown in FIGS. 5*a* and 5*b*.

As the flow velocity of plating solution increases, the cover 24 reduces the flow resistance to one half or less of that experienced in the absence of the cover as understood from the experimental data shown in Table 1. It is thus demonstrated that the cover 24 is very effective in reducing the flow resistance.

TABLE 1

| Flow velocity between anode and cathode, m/sec. | Flow resistance per channel, pressure loss in mmAq | |
|---|---|---|
| | Without cover | With cover |
| 0.5 | 80 | 65 |
| 1.0 | 160 | 80 |
| 1.5 | 240 | 100 |
| 2.0 | 360 | 140 |

In the radial plating cell 10 according to the present invention, each edge mask 18 is moved along with the travelling nut 22 which is threadably engaged on the drive screw and moved with rotation of the drive screw 20. The drive 30 which should be located outside the cell to rotate the drive screw 20 may be comprised of a motor 31 and a gear box 32. Only a very small space is necessary for installing such a drive.

On the contrary, in the arrangements shown in FIGS. 11 to 14 wherein drive means such as a hydraulic cylinder 62, an electrically powered cylinder 64, a rack and pinion 66 or a screw jack 68 is used to directly move the edge mask 18 through the support shaft 19, a space of a distance equal to the moving distance of the edge mask 18 is necessary outside the cell for allowing the support shaft 19 to move.

Figure 6:
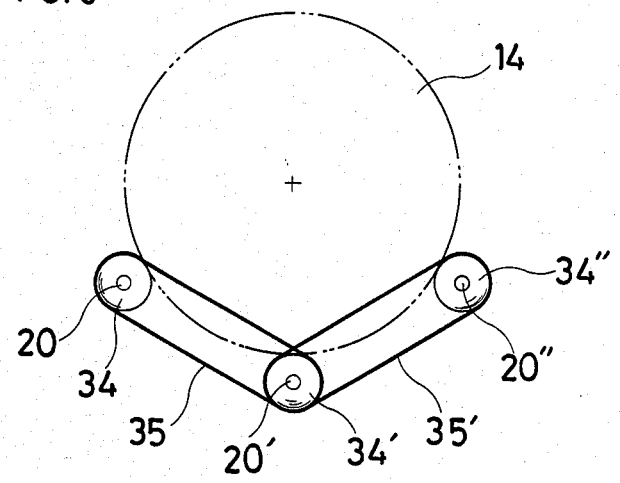
FIG. 6 is a schematic view showing a pulley and belt mechanism as one example of an edge mask synchronous drive applicable to the radial plating cell of the present invention.
Figure 7A:
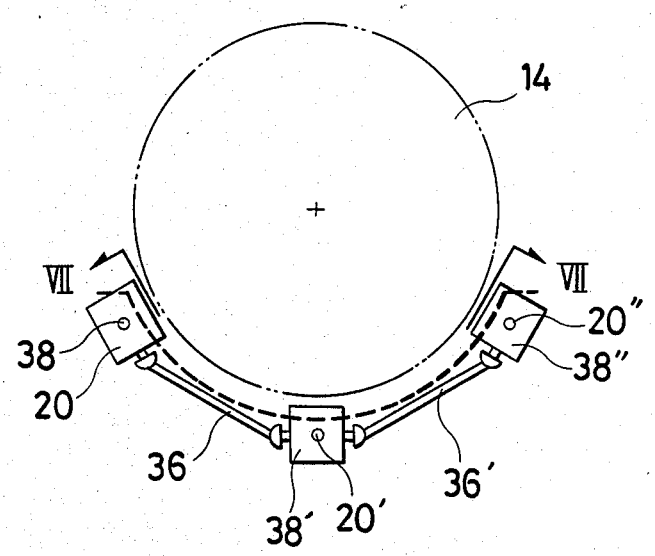
FIG. 7*a* is a schematic view showing a ball joint and gear mechanism as another example of an edge mask synchronous drive applicable to the radial plating cell of the present invention.
Figure 7B:
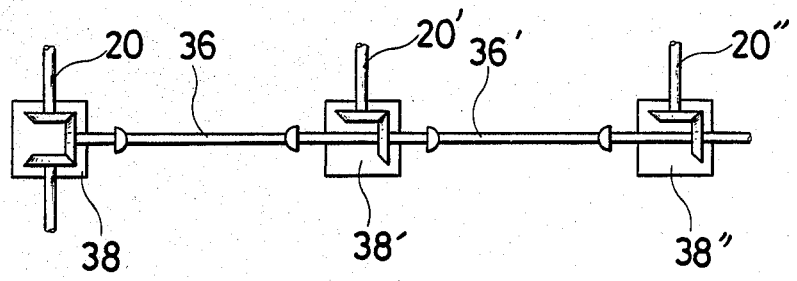
FIG. 7*b* is a schematic view taken along lines VII—VII in FIG. 7*a;*
Figure 9:
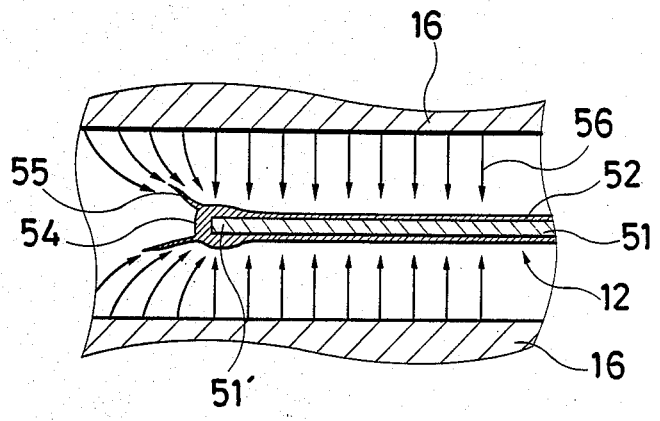
FIG. 9 illustrates the mechanism of abnormal plating phenomena in electroplating between the anode and the metal strip made cathode.
Figure 10:
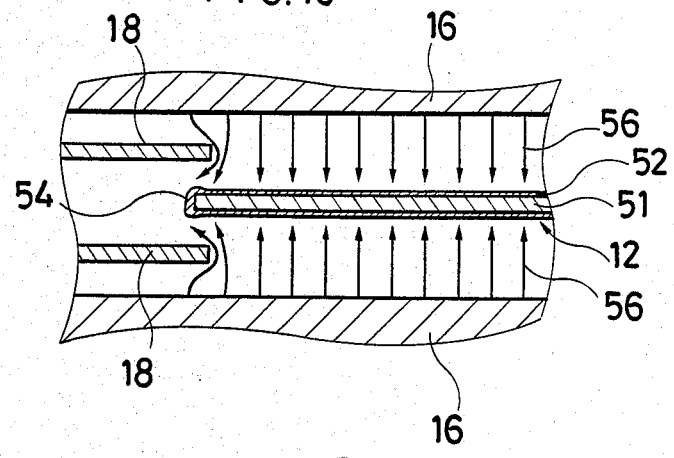
FIG. 10 illustrates edge masks which are interposed between the anode and the metal strip in order to prevent abnormal plating.
Figure 11:
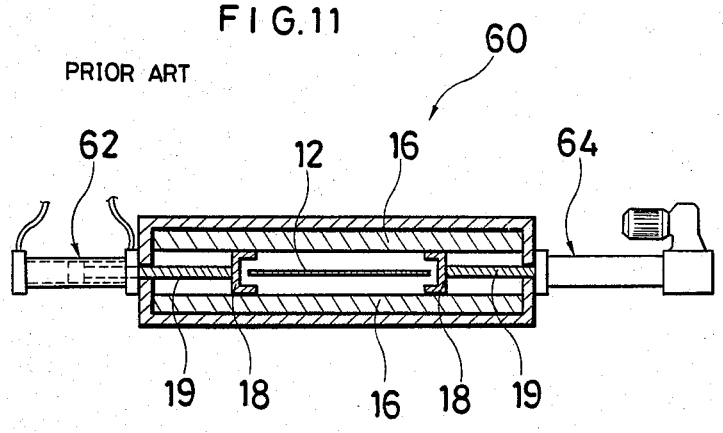
FIG. 11 PRIOR ART
FIGS. 11 and 12 are partially cross-sectional elevations of a conventional horizontal plating cell having different edge mask drive mechanisms.
Figure 12:
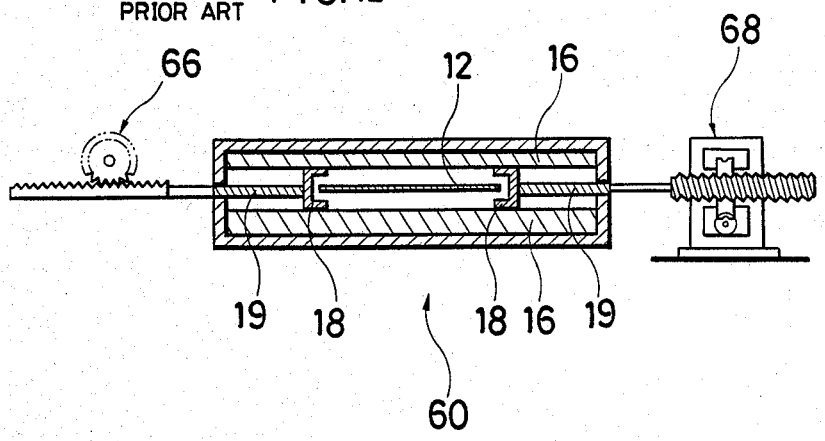
FIG. 12 PRIOR ART
Figure 13:
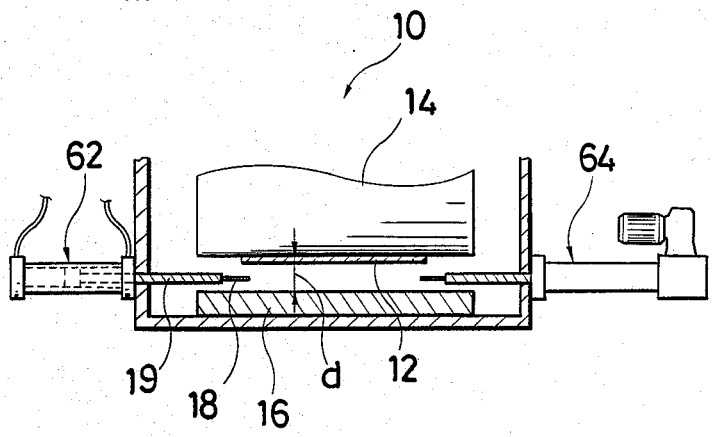
FIG. 13 PRIOR ART
FIGS. 13 and 14 illustrate partially cross-sectional elevations of a conventional radial plating cell having different edge mask drive mechanisms.
Figure 14:
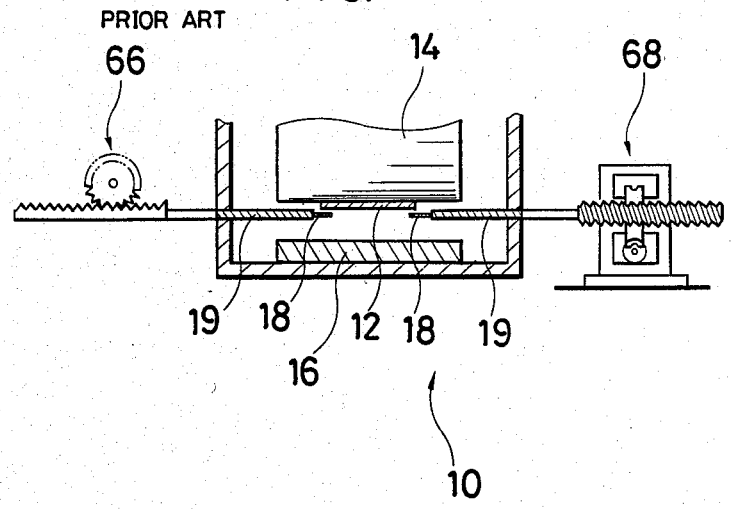
FIG. 14 PRIOR ART

The radial plating cell 10 of the present invention preferably includes synchronous drive means for synchronously driving a plurality of drive screws 20 so that a corresponding plurality of edge masks 18 may be properly moved without a positioning error. As shown in FIG. 6 wherein three drive screws are used, the synchronous drive means may be comprised of pulleys 34, 34' and 34'' attached to the drive screws 20, 20' and 20'', respectively, and timing belts 35 and 35' connected between the pulleys 34' and 34 and 34' and 34'', respectively. Alternatively, as shown in FIGS. 7*a* and 7*b*, equal speed ball joints 36, 36' and gears 38, 38', 38'' may be combined to constitute the synchronous drive means. The synchronous drive means is not particularly limited as long as it has a mechanism capable of synchronously driving a plurality of drive screws. Thus the synchronous drive means may be of any other desired mechanism, for example, a combination of chains and chain wheels.

The edge mask 18 must be accurately positioned in relation to the metal strip 12 such that the mask 18 overlaps the edge of the metal strip 12 over a predetermined extent as shown in FIG. 3. To this end, the left and right edge masks 18 are independently driven according to the present invention, as shown in FIG. 1. The position of the edge mask 18 may be determined by means of the revolution detector 33 which counts the number of revolutions of the drive screw 20. Then the left and right edge masks 18 may be controlledly positioned at any desired point in the transverse direction of the metal strip 12. If the left and right edges of a new metal strip 12 entering the radial plating cell 10 are detected, the edge masks 18 may be controlledly positioned so as to come in register with the edges of the strip, ensuring that the edge masks 18 be always held at proper positions.

Although the drive screw 20 is provided for each of the edge masks 18 so that the left and right edge masks 18 may be independently moved in the illustrated embodiments, the present invention is not limited to these embodiments. It is possible to use a common drive screw having oppositely threaded portions. Edge masks are engaged on the oppositely threaded portions and then moved toward and away from each other by rotating the screw. In this case, the metal strip 12 must be properly centered when it is wound on the winding roll 14.

Figure 8:
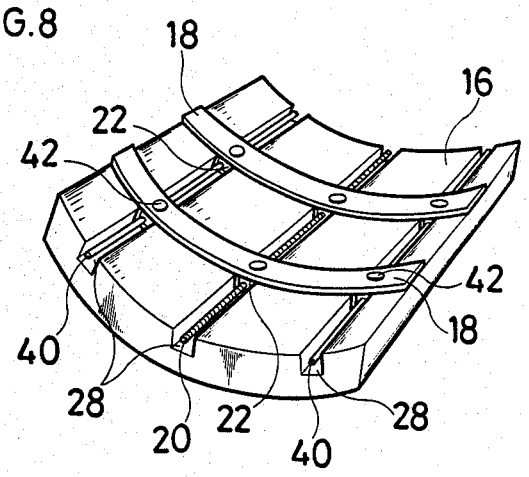
FIG. 8 is a perspective view of another example of the edge mask moving means applicable to the radial plating cell of the present invention.

Although three drive screws are used to move each edge mask 18 in the illustrated embodiments, the present invention is not limited to these embodiments. For example, one drive screw 20 is used to move the edge mask 18 as shown in FIG. 8. To force the edge mask 18 to move in parallel relation, followers 42 may be secured to opposite ends of the edge mask 18 and engaged with guide bars 40 located in parallel channels 28.

The radial plating cell of the above-described construction according to the present invention operates as follows.

As shown in FIGS. 1 to 3, the metal strip 12 is wound on the winding roll 14 of the radial plating cell 10. The transverse width of the metal strip 12 is determined. Then the edge masks 18 are moved on the arch-shaped anode 16 toward the corresponding edges of the metal strip 12 in accordance with the detected width. To this end, the drive means 30 is actuated. The rotational speed of the motor 30 is reduced through the gear box 31 to rotate the drive screw 20 at a proper speed. At this point, the number of revolutions of the drive screw 20 is counted by the revolution detector 33 to control the distance of movement of the edge mask 18. The drive screw 20 is fully received in the channel 28 which is formed in the surface of the anode 16 that is opposed to the winding roll 14 and extends in the transverse direction of the metal strip 12. Since the edge mask 18 is secured to the travelling nut 22 which is threadably engaged on the drive screw 20, rotation of the drive screw 20 causes the travelling nut 22 and hence, the edge mask 18 to move. Since the movement of the edge mask 18 is controlled by detecting the number of revolutions of the drive screw 20 by the revolution detector 33 as described above, the edge mask 18 is properly moved to the position corresponding to the edge of the metal strip 12. In this way, the edge mask 18 is positioned in register with the edge of the metal strip 12. The position of the edge mask 18 is fixed while metal strips of equal transverse width are being plated.

Since a plurality of drive screws 20, 20', 20'' are synchronously rotated by utilizing timing belts 35 and 35' which are trained around pulleys 34, 34', 34'' coaxially attached to the drive screws as shown in FIG. 6, each edge mask 18 having a substantial length in the longitudinal or carrying direction of the metal strip 12 can be properly moved in the transverse direction of the metal strip 12.

Since the cover 24 is placed in the channel 28 having the drive screw 20 and the travelling nut 22 received therein such that the cover 24 is flush with the anode 16 as shown in FIGS. 5*a* and 5*b*, plating solution can flow smoothly between the anode 16 and the metal strip 12.

The present invention can prevent edge overcoating without sacrificing the inherent advantage of a radial plating cell that the distance between a metal strip on a winding roll and an arch-shaped anode can be reduced because the drive means comprised of a drive screw and a traveling nut engaged thereon for moving an edge mask is received in a channel formed in the surface of the arch-shaped anode that is opposed to the winding roll.

Another advantage of the present invention is that the edge mask drive means located outside the cell may be a compact unit because the edge mask is secured to and moved along with the travelling nut which is threadably engaged on the drive screw and linearly moved with rotation of the drive screw. The drive means is merely required to rotate the drive screw.

The present invention is also effective in avoiding any turbulence in flow of plating solution between the anode and the cathode and reducing flow resistance because not only any mechanical member projecting between the winding roll or cathode and the arch-shaped anode can be omitted, but also any recess can be compensated for by placing a cover in the channel.

Finally, the edge mask can be readily located in register with the edge of a variety of metal strips having different transverse widths because the distance of movement of the edge mask can be controlled by detecting the number of revolutions of the drive screw.

We claim:

1. A radial plating cell comprising a winding roll for winding thereon a metal strip having longitudinal and transverse dimensions, an arch-shaped anode opposed to said winding roll and spaced at a predetermined distance from said winding roll, a pair of edge masks interposed between said winding roll and said anode so as to come in register with the edges of the metal strip, means for moving each of said edge masks in the transverse direction of the metal strip, and drive means for driving said moving means, said moving means comprising a drive screw and a travelling nut threadably engaged on said drive screw, said edge mask being operatively connected to said travelling nut, and said moving means being located in a channel which is formed in the surface of said anode that is opposed to said winding roll and extends in the transverse direction of the metal strip, whereby the travelling nut and hence, the edge mask is moved axially of said drive screw with rotation of said drive screw.

2. The radial plating cell of claim 1 wherein said edge mask is fixedly secured to said travelling nut.

3. The radial plating cell of claim 1 which further comprises a cover located over said channel.

4. The radial plating cell of claim 3 wherein said cover extends the axial distance of said channel.

5. The radial plating cell of claim 1 which comprises a plurality of said moving means which are synchronously driven by said drive means.

6. The radial plating cell of claim 1 which further comprises means for controlling the distance of movement of said edge mask.

7. The radial plating cell of claim 6 wherein said control means comprises a detector for counting the number of revolutions of said drive screw.

8. The radial plating cell of claim 1 wherein said anode is insoluble.

* * * * *